US007021484B2

(12) United States Patent
Herrmann

(10) Patent No.: US 7,021,484 B2
(45) Date of Patent: Apr. 4, 2006

(54) DEVICE INSERTED INTO THE SEALED LIDS OF METAL PACKAGING FOR LIQUID PRODUCTS

(75) Inventor: Marcos Bier Herrmann, Porto Alegre-RS (BR)

(73) Assignee: Renner Herrmann S/A, (BR)

( * ) Notice: Subject to any disclaimer, the term of this patent is extended or adjusted under 35 U.S.C. 154(b) by 0 days.

(21) Appl. No.: 10/764,038

(22) Filed: Jan. 23, 2004

(65) Prior Publication Data

US 2005/0161456 A1 Jul. 28, 2005

(51) Int. Cl.
*B65D 17/34* (2006.01)

(52) U.S. Cl. ..... 220/270; 220/906

(58) Field of Classification Search ..... 220/906, 220/271–273, 805, 269, 276, 214, 270
See application file for complete search history.

(56) References Cited

U.S. PATENT DOCUMENTS 3,494,500 A * 2/1970 Foster ..... 220/269
4,083,471 A * 4/1978 Frank ..... 220/269
4,674,649 A * 6/1987 Pavely ..... 220/271
5,054,642 A * 10/1991 Yoshida ..... 220/276
5,328,045 A * 7/1994 Yoshida ..... 220/359.2
5,688,544 A * 11/1997 Bolton et al. ..... 426/118

* cited by examiner

*Primary Examiner*—Lien M. Ngo
(74) *Attorney, Agent, or Firm*—Ostrolenk, Faber, Gerb & Soffen, LLP

(57) ABSTRACT

"DEVICE INSERTED INTO THE SEALED LIDS OF METAL PACKAGING FOR LIQUID PRODUCTS", comprising a fixing system obtained through a process of crimping to the upper edge of the metal package (1), preferably made of tinplate, characterized by an assembly comprising a plastics membrane (2) and a metal ring (3) stamped to form a flat inner cross section (4), which has a central circular opening (5) with an inner edge turned downward and folded inward (6), and an elevation to form a lower seat (7) which is surrounded by a peripheral rim facing downward and slightly inward (8) to enable crimping together with the aforesaid membrane (2); the peripheral edge (9) which is inserted into the seat (7) for crimping onto the edge of the packaging (1), followed internally by an annular recess (10) into which the flat inner cross section (4) of the metal ring (3) with the inner edge turned down and folded inward (6) is inserted, this being followed internally by a perimetral annular reinforcement (11) and with the lower triangular thinned line (12) being broken when the incorporated pulling ring (13) is pulled; when the ring (13) is pulled the tilting triangular lid (14) breaks partly along the more solid thinned line (15); said thinned line (12) is provided with a restraint (16).

1 Claim, 2 Drawing Sheets

DEVICE INSERTED INTO THE SEALED LIDS OF METAL PACKAGING FOR LIQUID PRODUCTS

Figure 1:
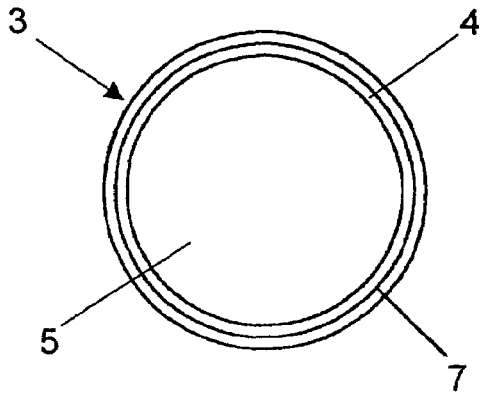

"DEVICE INSERTED INTO THE SEALED LIDS OF METAL PACKAGING FOR LIQUID PRODUCTS" relates to a practical and innovative design of a sealing lid in the field of plastics injection systems for use more specifically in metal packages for liquid foodstuffs and the like which has been given an original embodiment in order to improve its use and performance in comparison with other designs normally found on the market.

The patent application in question therefore relates to an improvement made in sealed lids for metal containers for liquid foodstuffs, the implementation of which is designed to produce a sealed lid which ensures the necessary seal and consequently protects the quality of the packaged product, as well as ensuring that there is no possibility of injury to the fingers and ensuring preservation of the product after the package has been opened.

As is commonly known, there are different types of fruits from which the juice is extracted.

As is known, particularly by those skilled in the art, in current processes, after the juice has been extracted, it is packed in packages to increase its useful life and prevent contact with aerobic bacteria, which also makes it possible for it to be stored in air-conditioned premises for a prolonged period of time.

In the normal way these storage locations are cold rooms which extend the life of the products and preserve them.

The great disadvantage of these systems lies specifically in the fact that these packages are often made from cut, rolled and welded tinplate with their ends closed off by an inserted disk of the same material, while the top is sealed with a piece identical to the base, by the same process.

As is generally known, this process of sealing the two ends causes problems for final consumers who must have a can-opener to perforate and remove the central part of the can containing the juice, thus running the risk of injuring themselves on the sharp edges produced by the can-opener.

It was in the light of these disadvantages that, after much research and investigation, the inventor, a person linked with the art, created and developed the subject matter of this patent, envisaging a sealed lid in which not only mechanical and functional qualities were considered in the plan for its manufacture, but also the shape, arrangement and location of its parts and components which, when correctly positioned, would result in an increase in efficiency without incorporating any disadvantage.

This patent application therefore relates to a design developed through an improvement introduced in the sealed lid of metal containers for liquid foodstuffs which comprises a form of construction in which the can is sealed by a unit consisting of an injected LDPE plastics membrane provided with a peripheral flap, a thinned triangular line with curved lateral edges to facilitate breakage and a third line, of lesser depth, designed to impart a tilting movement upon the seal.

An incorporated pulling ring, together with an upper annular recess to accommodate a stamped laminar ring manufactured of tinplate is fitted to the above-mentioned thinned triangular line with curved lateral edges, the inner edge of the tinplate being turned down and folded so as not to expose its sharp edge, with the outer edges of this assembly secured to the upper edge of the aforesaid package through the crimping process, with the aforesaid laminar ring having an internal diameter at slight distance from said thinned triangular line of the plastics membrane to serve as a support for that line and to help break it when the user pulls the ring to bring about opening of the package.

The posterior seal for this package is provided by the tilting lid produced after breakage of the thinned line, through a restraint located at the end and above the base of the tilting triangular lid produced after breakage.

It should thus be understood that the sealed lid in question is of extremely simple construction, being therefore easy to construct, so excellent practical and functional results are obtained, offering a form of construction which is innovative in comparison with known designs.

The purpose of this application is therefore to provide a closure assembly providing a leaktight seal for packaging for liquid food products with low costs in industrial implementation but also fulfilling the requirements of rendering it tamper-proof, hygienic, safe and of practical use, thus offering the consuming public an additional option in the market for similar items.

Thus this patent has been designed with a view to obtaining a sealed lid with the smallest number of parts possible, but conveniently configured and arranged to permit a package to be sealed and its contents preserved for a longer time without the disadvantages already mentioned.

Its innovative composition means that it provides an excellent level of functionality, offering an embodiment of a sealed lid having great durability, being created mainly to preserve the tamper-proof quality of the package before opening and the characteristics of the product after the package has been opened.

For a better understanding of what the "DEVICE INSERTED INTO THE SEALED LIDS OF METAL PACKAGING FOR LIQUID PRODUCTS" which is applied for here comprises, the appended illustrative drawings are provided as an appendix, in which:

FIG. 1—shows a top view, giving prominence to the stamped metal laminar ring.

Figure 2:
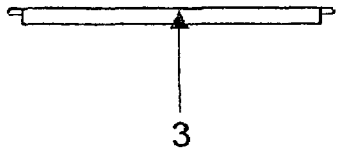

FIG. 2—shows a view in longitudinal cross section to illustrate the shape of the stamped metal laminar ring.

Figure 3:
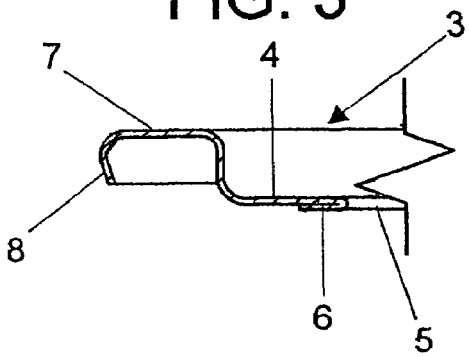

FIG. 3—shows a view in vertical cross section to illustrate the shape of the stamped metal laminar ring.

Figure 4:
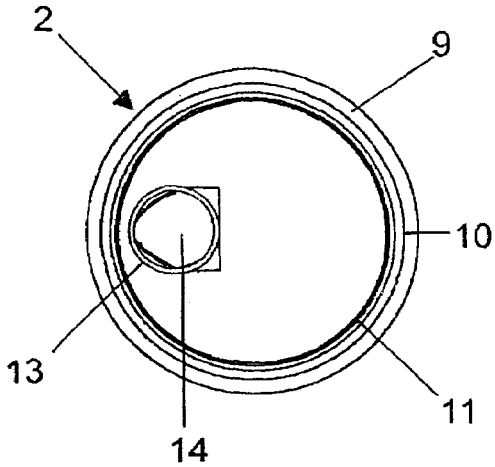

FIG. 4—shows an upper view of the injected plastics membrane, giving prominence to incorporated pulling ring and the thinned breaking line of the triangular lid.

Figure 5:
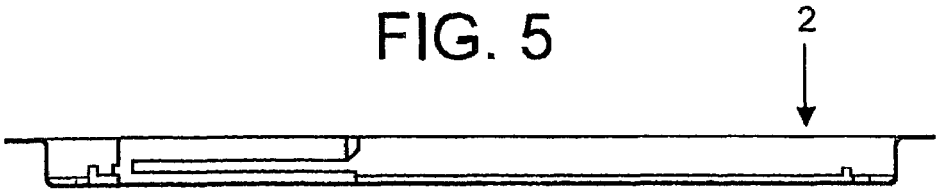

FIG. 5—shows a view in cross section to illustrate the shape of the injected plastics membrane with the incorporated pulling ring.

Figure 6:
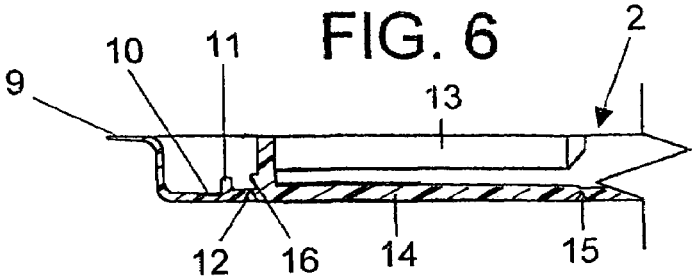

FIG. 6—shows a view in vertical cross section of the shaped injected plastics membrane, with prominence being given to the incorporated pulling ring, the seat to accommodate said metal ring and the thinned breaking line close to the reinforcing projection.

Figure 7:
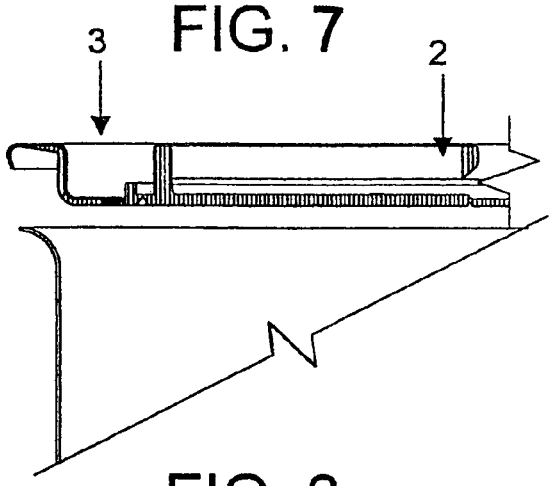

FIG. 7—shows a view in vertical cross section detailing the superimposition of the metal ring on the plastics membrane in a position for fitting on the opening of the metal package for subsequent crimping.

Figure 8:
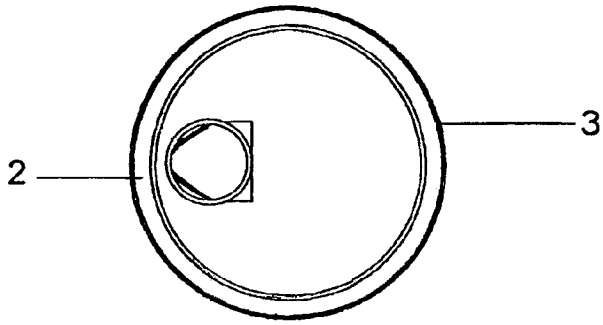

FIG. 8—shows a top view of said metal packaging with the plastics membrane and the metal laminar ring crimped.

Figure 9:
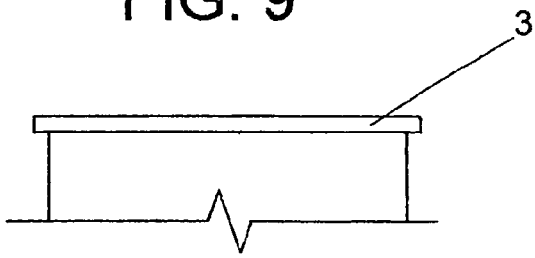

FIG. 9—shows a side view of a cylindrical metal package, giving prominence to the top crimped attachment which takes the ring and the membrane sealing the package.

Figure 10:
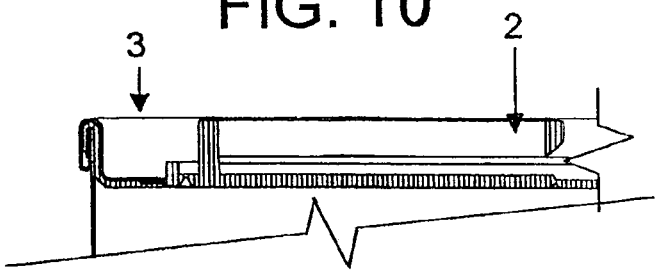

FIG. 10—shows a view in partial cross section giving prominence to the plastics membrane which has received the superimposed metal laminar ring crimped to the edge sealing the package.

As illustrated in the above-mentioned figures, the "DEVICE INSERTED INTO THE SEALED LIDS OF METAL PACKAGING FOR LIQUID PRODUCTS" to which this patent relates is essentially characterized in that it comprises being fixed by a process of crimping to the upper edge of the metal packaging (1), preferably made of tinplate.

Said packaging (1) has associated with it an assembly comprising a plastics membrane (2) and a metal ring (3) stamped to have a flat internal cross section (4), which has a central circular opening (5) with an inner edge turned down and folded inward (6) and a raised portion to form a lower seat (7) surrounded by a peripheral rim facing downward and slightly inward (8) to permit crimping together with said membrane (2).

The above-mentioned crimping shapes the peripheral edge (9) which is inserted into the seat (7) for crimping to the edge of the packaging (1), followed internally by an annular recess (10) where the flat inner cross section (4) nests in the turned down and inwardly folded inner edge (6) of metal ring (3), this being followed internally by a perimetral annular reinforcement (11) and the lower triangular thinning line (12) which is broken when the incorporated pulling ring (13) is pulled.

On being pulled with the fingers said ring (13) partly breaks tilting triangular lid (14) along the more solid thinned line (15) attaching the tilting triangular lid (14) in the opening produced by breaking along the thinned line (12), this being provided with a restraint (16) on the base supporting pulling ring (13).

This description therefore relates to a new design of a sealed lid, which as we can see from the description provided and the figures illustrated has many differences from conventional designs in existence in the consumer market, as well as technical structural and functional features which are completely different from those pertinent to the state of the art. Through the advantages which it offers, and also because it has truly innovative features which fulfill all the requirements for novelty and originality in the field, this "DEVICE INSERTED INTO THE SEALED LIDS OF METAL PACKAGING FOR LIQUID PRODUCTS" meets the conditions necessary to merit the status of a Utility Model.

Although this application has been illustrated and described with reference to the embodiment claimed above, it will be apparent to those skilled in the art that other modifications in shape and detail may be made thereto without going beyond the spirit and scope of what has been claimed, as defined in the appended claim.

What is claimed is:

1. An end seal device for sealing an open end of a metal package, comprising:

a plastic membrane; and a metal ring stamped to have a flat inner cross-section having a central circular opening with a turned down and inwardly folded inner edge, and an elevation that forms a lower seat surrounded by a downwardly and inwardly facing peripheral rim whereby the metal ring can be crimped with the membrane, the membrane having a peripheral edge inserted into the seat for crimping to an edge of the package, the membrane having an annular recess internally adjacent the peripheral edge, the flat inner cross section of the metal ring with the turned down and inwardly folded inner edge being inserted in the annular recess, the annular recess being followed internally by a perimetral annular reinforcement, a pull ring and a first, lower triangular thinned line that is formed to break when the pull ring is pulled, wherein the pull ring breaks partly at a tilting triangular lid along a second, more solid thinned line, a restraint being provided in a region of the first thinned line.

* * * * *